US005240237A

United States Patent [19]

Nakura et al.

[11] Patent Number: 5,240,237

[45] Date of Patent: Aug. 31, 1993

[54] AIR FLOW PATH SWITCHING DEVICE FOR PRINTING APPARATUS

[75] Inventors: Makoto Nakura; Akira Terakado; Yoshihiro Gunji, all of Ibaraki, Japan

[73] Assignee: Hitachi Koki Co., Ltd., Tokyo, Japan

[21] Appl. No.: 789,608

[22] Filed: Nov. 8, 1991

[30] Foreign Application Priority Data

Nov. 30, 1990 [JP] Japan ..... 2-337689

[51] Int. Cl.[5] ..... B65H 3/44

[52] U.S. Cl. ..... 271/9; 271/11; 271/98

[58] Field of Search ..... 271/9, 11, 108, 98, 271/97, 94, 65, 186

[56] References Cited

U.S. PATENT DOCUMENTS

| | | | |
|---|---|---|---|
| 4,066,252 | 1/1978 | Wick | 271/65 X |
| 4,513,956 | 4/1985 | Sigvarodt et al. | 271/94 X |
| 4,553,828 | 11/1985 | Burger et al. | 271/65 X |
| 4,842,263 | 6/1989 | Robertson | 271/65 X |
| 4,928,128 | 5/1990 | Stemmle | 271/186 X |

FOREIGN PATENT DOCUMENTS

| | | | |
|---|---|---|---|
| 488518 | 7/1938 | United Kingdom | 271/108 |

*Primary Examiner*—David H. Bollinger
*Attorney, Agent, or Firm*—Sughrue, Mion, Zinn, Macpeak & Seas

[57] ABSTRACT

An air flow path switching device for a printing apparatus includes a sheet hopper which holds a plurality of sheets, a sheet switchback device for inverting the sheets so that both sides of the sheets can be printed on, sheet pickup devices associated, respectively, with the sheet hopper and the sheet switchback device for picking up sheets, and a blower device for supplying pressurized suction and discharge air to the sheet pickup devices. An air flow resistance existing in the sheet switchback device, when the sheet pickup device associated with the sheet hopper is connected to the blower, and an air flow resistance existing in the sheet switchback device, when the sheet pickup device associated with the sheet hopper is disconnected from the blower, are substantially equivalent.

2 Claims, 2 Drawing Sheets

← ··· FLOW OF AIR

← ··· FLOW OF SHEET

AIR FLOW PATH SWITCHING DEVICE FOR PRINTING APPARATUS

BACKGROUND OF THE INVENTION

The present invention relates to an air flow path switching device that is disposed on pipings between a blower that supplies air and units that need the air.

There is presently a growing demand for cut sheet printing double-side printing, and high-speed printing, and cut sheet printers accommodating such demand often employ a technique in which sheets are separated and forwarded using pressurized air to improve reliability in sheet feeding and forwarding.

The flow of a sheet in a cut sheet laser printer and its air system including an air flow path switching device will be outlined first with reference to FIG. 3.

Sheets are picked up on a single piece basis from a main hopper 1, and toner is transferred onto the sheet at a photosensitive drum 2 and fixed onto the sheet by a fixing unit 3. Printing on one surface of the sheet is now completed. To print on the back surface of the sheet, the sheet is forwarded to a switchback section 5 while inverted by an invertor section 4, and toner is then transferred onto the back surface of the sheet again by the photosensitive drum 2 and fixed by the fixing unit 3. Upon completion of the printing on both surfaces of the sheet, the sheet is forwarded to a stacker 6. The sheets are picked up not only from the main hopper 1 but also from an auxiliary hopper 7 as necessary, and printed in a similar process.

The main hopper 1 and the auxiliary hopper 7 serve to pick up sheets correctly on a single piece basis for the subsequent process of printing. Thus, air is blown to the front end portions of the sheets from a nozzle 8 so as to separate overlapping sheets, and the topmost sheet is thereafter picked up by sucking air from a chamber 9 through the pick belt 10. The switchback section 5 serves to pick up a single sheet correctly, the sheet being the bottommost sheet in the sheets that are inverted and temporarily stacked for back-side printing. The switchback section 5 similarly includes a nozzle 11, a chamber 12, and a pick belt 13.

Sucking and blowing of air at the main hopper 1, the auxiliary hopper 7 and the switchback section 5 are performed by a blower 14. The blower 14 is connected with these units by a pipe 15. An air flow path switching device 16 is provided between the main hopper 1 and the auxiliary hopper 7, since these hoppers are not to be operated simultaneously. The air flow path switching device 16 serves to switch the flow of air as necessary, and stops air supply when neither the main hopper 1 nor the auxiliary hopper 7 is in use.

The construction of the air flow path switching device 16 will be described next with reference to FIG. 4.

Holes are provided on the sidewall of a cylinder 17. Holes 18, 19 are connected to a sucking inlet 20 and discharge outlet 21 of the blower 14, respectively, by the hose 15; holes 22, 23 are connected to the chamber 9 and the nozzle 8 of the main hopper 1, respectively, while holes 24, 25 are connected to a chamber 26 and a nozzle 27 of the auxiliary hopper 7.

A rotor 28 is disposed inside the cylinder 17 and, is rotated around the cylindrical axis by a (not shown) motor. In the rotor 28 recesses are formed on a flat surface 29 that extends in parallel to the cylindrical axis. By rotating the rotor 28 inside the cylinder 17 and stopping it at an appropriate position, an air flowing direction is determined; i.e., the main hopper and the auxiliary hopper can be switched. FIG. 4 is a diagram showing a state in which the air flow is switched to the auxiliary hopper 7.

A positional relation between the cylinder 17 and the rotor 28 is shown in FIG. 5 when neither the main hopper 1 nor the auxiliary hopper 7 are supplied with air (in a neutral condition). Accordingly, the neutral condition is employed to avoid supplying air to the main or auxiliary hopper, when air is unnecessary. Therefore, in the case where the air is unnecessary, if the air is applied, to the main or auxiliary hopper during the neutral condition, the sheet existing in the hopper may be damaged, i.e. the sheet may be rolled up, curled up or the like. The neutral condition is designed to In the rotor 28 another recess is formed on a flat surface 30 that is parallel to the flat surface 29, the rotor 28 being positioned such that the flat surface 30 confronts the holes 18, 19 (a neutral position). In this position, the air discharged from the discharge outlet 21 of the blower 14 enters the cylinder 17 from the hole 19, passes through the hole 18, and returns to the sucking inlet, 20 of the blower 14, thereby flowing neither through the main hopper 1 nor the auxiliary hopper 7.

However, in such conventional assemblies, in which the discharge outlet 21 and the sucking inlet 20 of the blower 14 are connected inside the cylinder 17, the air is directed to flow through the cylinder 17 during the neutral condition. As a result, the air pressure at the switchback section 5 in the neutral condition becomes less than that in the non-neutral condition. Conversely, as shown in FIG. 6, the structure in which the holes 18, 19 are closed by the rotor 28 in the neutral condition allows air to flow only to the switchback section 5, thereby making the air pressure at the switchback section 5 greater in the neutral condition than in the non-neutral condition.

These fluctuations of the air pressure cause defective sheet forwarding at the switchback section 5, thereby greatly impairing the reliability of the printer.

SUMMARY OF THE INVENTION

An object of the invention is to eliminate the aforesaid shortcomings associated with the conventional art and improve reliability in sheet forwarding performance of the printers of this type.

The invention attempts to improve the shape and structure of the cylinder and rotor consisting of an air flow path switching device so that the air flow of one unit can be controlled without influencing the air pressure of the other unit, paying attention to the fact that when the resistance of one of the two units parallelly connected to a blower is increased, the air pressure of the other unit is increased, while when the resistance of one unit is decreased, the air pressure of the other unit is decreased.

DETAILED DESCRIPTION OF THE EMBODIMENTS

Figure 1:
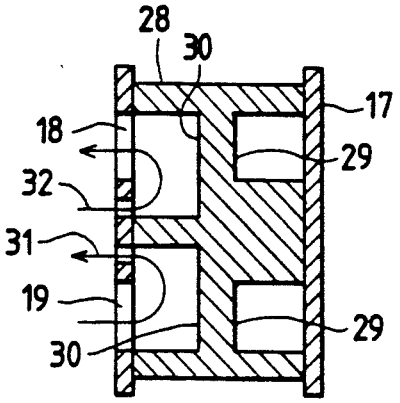
FIG. 1 is a longitudinal sectional view showing an embodiment of an air flow path switching device of the invention in a neutral condition.

FIG. 1 shows a sectional view of an air flow path switching device of the invention in a neutral condition.

A hole 31 is provided on the sidewall of a cylinder 17. In the neutral condition, air discharged from a discharge outlet 21 of a blower 14 enters the cylinder from a hole 19, passes through the hole 31, and is discharged outside the cylinder 17. In this, case, the shape and dimensions of the hole 31 is selected such that a resistance produced at the time the air flows from nozzles 8, 27 is substantially equivalent to a resistance produced at the time the air flows through the hole 31. As a result, air discharge pressure at a nozzle 11 in a switchback section 5 in the neutral condition can be made equal to that in the non-neutral condition.

Similarly, a hole 32 is provided on the sidewall of the cylinder 17 so that air is sucked from without the cylinder 17. And the shape and dimensions of the hole 32 is so selected that a resistance produced, at the time the air flows through the chambers 9, 28 is substantially equivalent to a resistance at the time the air flows through the hole 32 can be made equivalent. As a result, the air sucking pressure from a chamber 12 at the switchback section 5 in the neutral condition can be made equal to that in the non-neutral condition.

While a technique in which the air is leaked from both holes formed on the sidewall of the cylinder has been presented for sucking and discharging in the aforesaid embodiment, the leaking of air from only one of the holes may likewise be effective.

Figure 2:
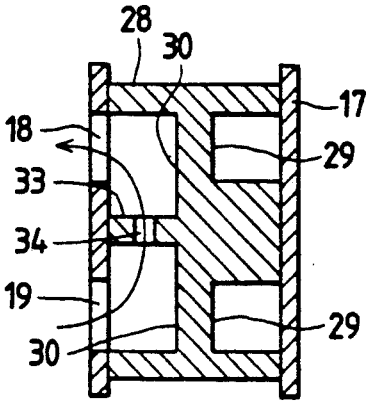
FIG. 2 is a longitudinal sectional view showing a modification of the air flow path switching device of the invention.
Figure 3:
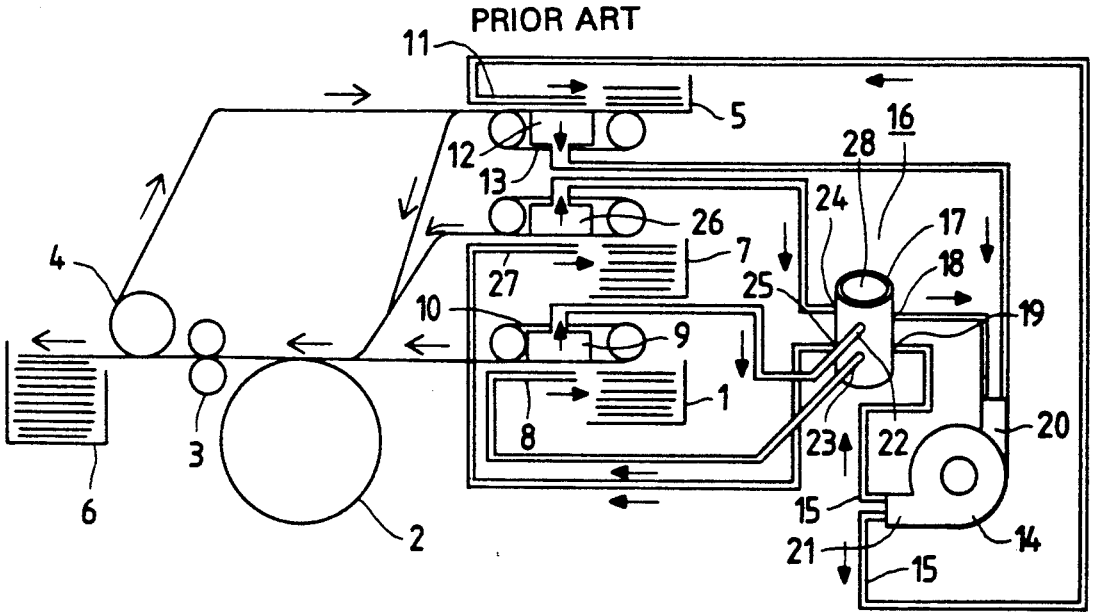
FIG. 3 PRIOR ART
FIG. 3 is a conceptional diagram schematically, showing a sheet forward path and an air flow path of a conventional cut sheet laser printer.
Figure 4:
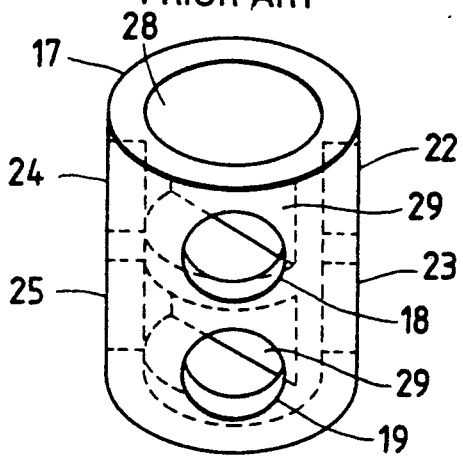
FIG. 4 PRIOR ART
FIG. 4 is a perspective view showing a cylinder and a rotor constituting conventional air flow path switching device.
Figure 5:
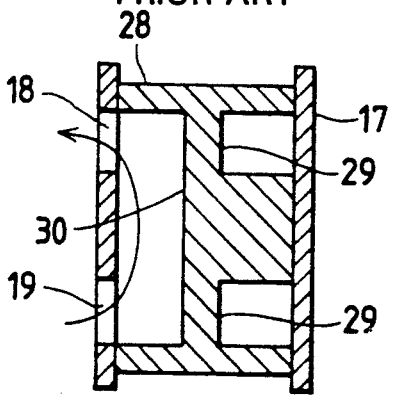
FIG. 5 PRIOR ART
FIGS. 5 and 6 are sectional views showing a conventional air flow path switching device in a neutral condition.
Figure 6:
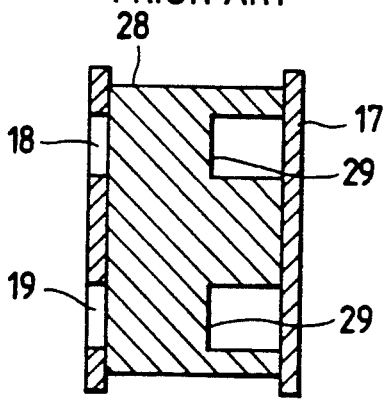
FIG. 6 PRIOR ART

In addition, it is not requisite to provide the air leak holes on the sidewall of the cylinder. A similar effect may be obtained by arranging the holes on a part of the rotor As, for example by forming an appropriate hole 34 on a partition wall 33 arranged on a part of the rotor as shown in FIG. 2.

According to the present invention, the air pressure is made equal at the switchback section both in the neutral condition and in the non-neutral condition of the air flow path switching device. Therefore, when both the main hopper and the auxiliary hopper are used, or when neither hoppers are used, the sheet forwarding performance by the switchback section is not affected, thereby contributing to improving the printer reliability.

What is claimed is:

1. An air flow path switching device for an electrophotographic apparatus, comprising:

at least one sheet hopper for accommodating sheets to be printed;

sheet switchback means for inverting said sheets so that said sheets may be printed on both sides thereof;

first sheet pick up means associated with each of said at least one sheet hopper for picking up said sheets;

second sheet pick up means associated with said sheet switchback means for picking up said sheets; and blower means for applying pressurized air to said first and second sheet pickup means, wherein a first air flow path is defined between said first sheet pickup means and said blower means through an air flow path switching means, a second air flow path is defined between said second sheet pickup means and said blower means, directly, and an air sucking pressure existing in said sheet switchback means, when said first sheet pickup means is connected to said blower means, and the air sucking pressure existing in said sheet switchback means, when said first sheet pickup means is disconnected from said blower means, are substantially equivalent.

2. An air flow path switching device for an electrophotographic apparatus as claimed in claim 1, wherein said sheet pickup means comprises:

air blowing means for separating said sheets; and air sucking means for sucking said sheets separated by said air blowing means.

* * * * *